US008250951B2

(12) United States Patent
Chuang

(10) Patent No.: US 8,250,951 B2
(45) Date of Patent: Aug. 28, 2012

(54) TOOL OF TOOL SET

(76) Inventor: Louis Chuang, Taichung (TW)

( * ) Notice: Subject to any disclaimer, the term of this patent is extended or adjusted under 35 U.S.C. 154(b) by 265 days.

(21) Appl. No.: 12/721,877

(22) Filed: Mar. 11, 2010

(65) Prior Publication Data

US 2010/0319501 A1 Dec. 23, 2010

(30) Foreign Application Priority Data

Jun. 23, 2009 (TW) ..... 98120935 A

(51) Int. Cl.
*B25B 23/00* (2006.01)
*B25B 15/00* (2006.01)

(52) U.S. Cl. ..... 81/440; 7/168; 81/177.4

(58) Field of Classification Search ..... 81/440, 81/177.4, 177.6, 439, 490; 7/118, 138, 168; D8/26, 105
See application file for complete search history.

(56) References Cited

U.S. PATENT DOCUMENTS

| | | | | |
|---|---|---|---|---|
| 2,804,970 | A * | 9/1957 | Kuc et al. | 81/440 |
| D427,875 | S * | 7/2000 | Chiu | D8/105 |
| 6,601,481 | B2 * | 8/2003 | Chuang | 81/440 |
| D542,111 | S * | 5/2007 | Te | D8/105 |

FOREIGN PATENT DOCUMENTS

| | | |
|---|---|---|
| TW | M254318 | 1/2005 |

* cited by examiner

*Primary Examiner* — Hadi Shakeri
(74) *Attorney, Agent, or Firm* — Alan Kamrath; Kamrath IP Lawfirm, PA

(57) ABSTRACT

A tool is made from a body and includes a driving end formed on a proximal end of the body for performing a specific procedure and a connecting end formed on the distal end of the body by bending the distal end. The distal end is formed to have a rectangular cross section prior to forming the connecting end.

4 Claims, 11 Drawing Sheets

TOOL OF TOOL SET

BACKGROUND OF THE INVENTION

1. Field of the Invention

The present invention relates to tools of a tool set each including a connecting end connected to the tool set more stably than the prior art.

2. Description of the Related Art

A tool set, which includes a plurality of tools each including a connecting end pivotally connected to a pivot, is known. It is also known that each of these tools is manufactured from a body which extends longitudinally and has a constant hexagonal cross section, and that its connecting end is formed by bending a distal end of the body. FIG. 10 shows a tool 90 of this kind. The tool 90 is made from a body and includes a connecting end 91 made of the same and defined at the distal end of body. Additionally, the connecting end 91 has a center of curvature, i.e. where the cross mark is, located in a space delimited therefrom. Furthermore, the distal end of the body includes a side facing the body and being at an acute angle "θ" with respect to the body.

It should be appreciated that bending the hexagonal body to form the connecting end 91 is not easy work. Since the body is not liable to deformation, it requires substantial effort and caution to avoid breakage, due to stress concentration during the process. Obviously, the bigger the cross-sectional size of the body, the harder it is to bend.

TW Pat. No. M254318 shows a tool set including a plurality of tools. Each tool is made from a body having a hexagonal cross section and includes a connecting end made by bending a distal end of the body. It should be noticed that each tool has a specific cross sectional size, and the connecting end of one tool is with a curvature differentiating from that of another tool. As a result, the tool set can not have an even and smooth appearance when all the tools are stowed therein.

In addition, FIG. 11 shows a tool 90A made from a body having a hexagonal cross section and including a connecting end 92A by forging a distal end of the body instead of by bending. However, the forging process has an adverse effect of increasing the cost for manufacturing the tool 90A.

The present invention is, therefore, intended to obviate or at least alleviate the problems encountered in the prior art.

SUMMARY OF THE INVENTION

According to the present invention, a tool is made from a body and is adapted to be pivotally connected to a housing member. The tool includes a driving end formed on a proximal end of the body for performing a specific procedure and a connecting end formed on a distal end of the body by bending the distal end, with the distal end having a rectangular cross section. The connecting end is formed such that it extends in a path away from the body initially and towards the body at last and encloses a space. The connecting end includes an inner side and an outer side which are substantially even, with the inner side enabling the tool to have a surface contact area with a pivot in the housing member.

Other objects, advantages, and new features of the present invention will become apparent from the following detailed description of the invention when considered in conjunction with the accompanied drawings.

DETAILED DESCRIPTION OF THE PREFERRED EMBODIMENTS

Figure 1:
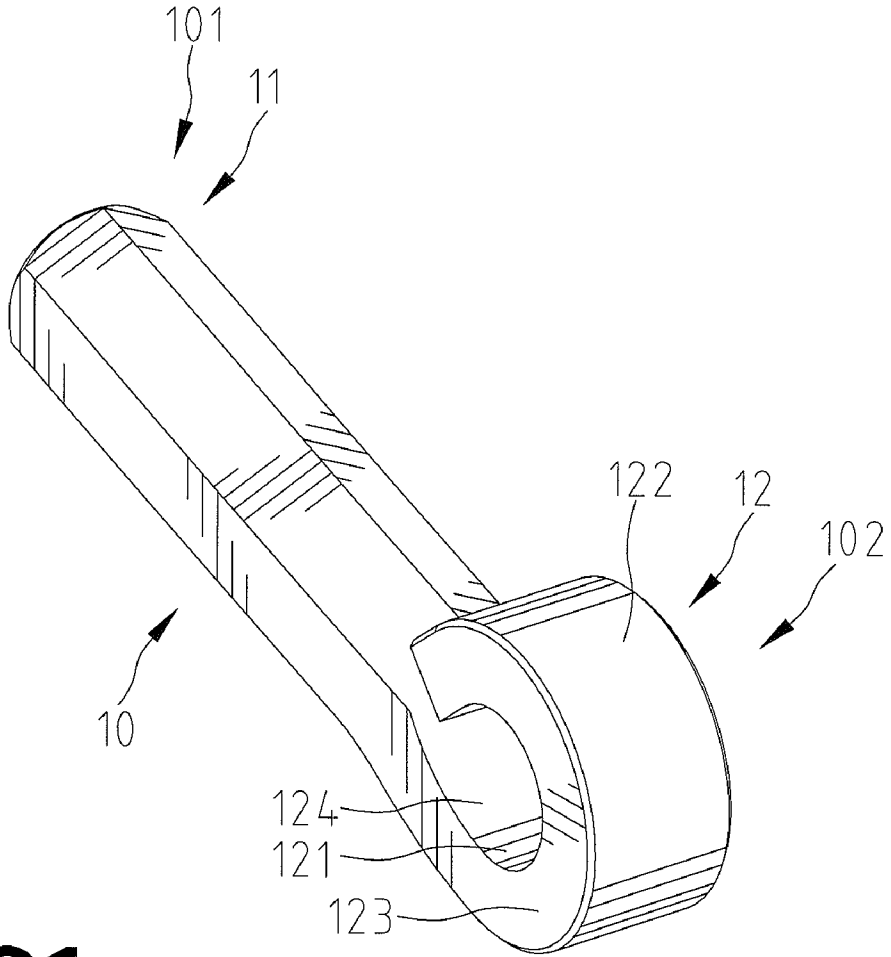
FIG. 1 is a perspective view of a tool in accordance with a first embodiment of the present invention.
Figure 2:
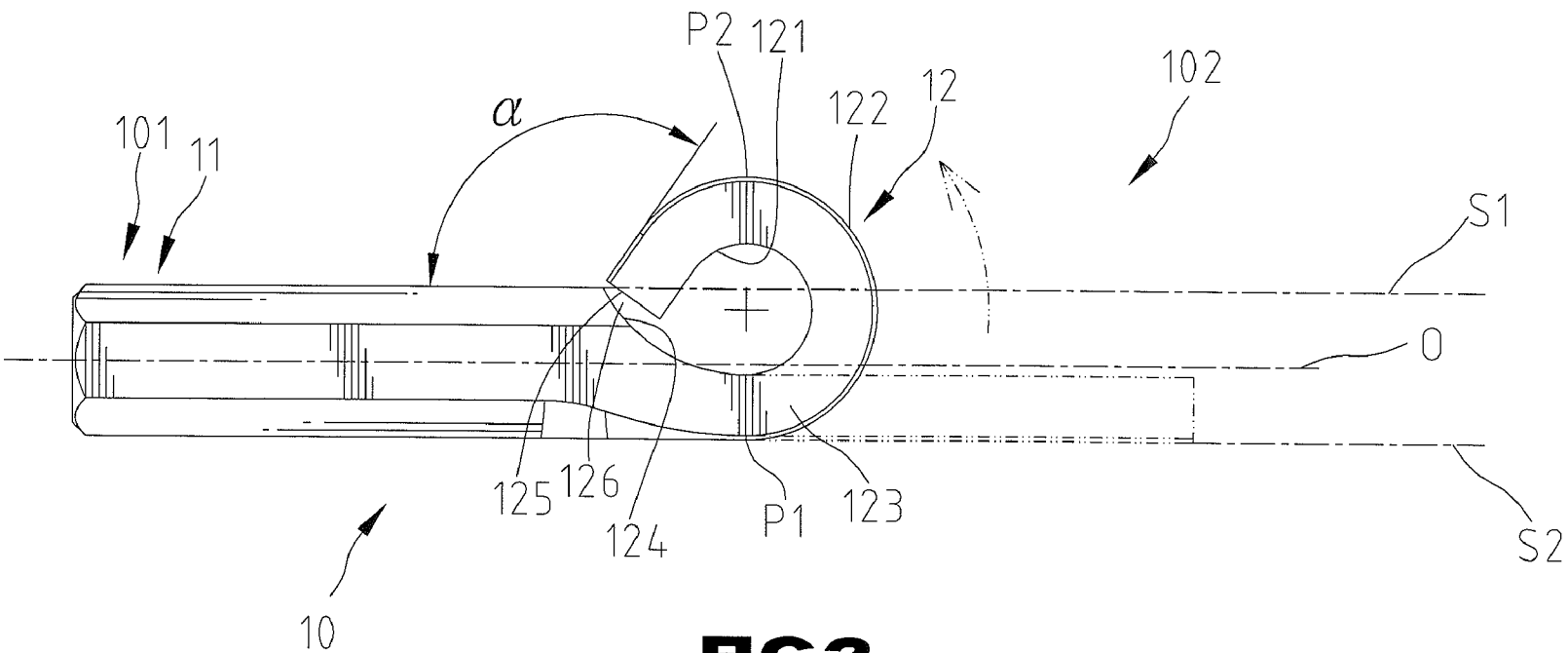
FIG. 2 is a side view of the tool of FIG. 1 and illustrates the tool made from a body and including a portion thereof bent to form a connecting end at a distal end of the body.

FIGS. 1 and 2 show a tool 10 in accordance with a first embodiment of the present invention. The tool 10 is made from a body manufactured from a bar and preferably including a constant hexagonal cross section along its length. However, it is understood that the bar may have other cross sectional shapes than being hexagonal, for example, a circular cross section. The body includes a proximal end 101 and a distal end 102 opposing one another, and the proximal end 101 defines a driving end 11 of the tool 10. In addition, the tool 10 includes a connecting end 12 formed by bending the distal end 102 of the body. Prior to forming the connecting end 12 of the tool 10, the distal end 102 of the body is punched to transform its cross section from being hexagonal, as in the embodiment, to become rectangular. Particularly, the distal end 102 of the body includes a first pair of opposing even surfaces including a first even surface in connection with two adjacent peripheral sides of the hexagonal body and a second even surface in connection with another two adjacent peripheral sides, a second pair of opposing even surfaces including a third even surface in connection and aligned (or being flush) with one of the other two peripheral sides of the hexagonal body and a fourth even surface in connection and aligned (or being flush) with the other of the other two peripheral sides, as well as a fifth even surface which curves and extends between the first even surface and the peripheral sides of the hexagonal body associated with the first even surface. Prior to forming the connecting end 12, the body also includes a first tangential edge defined from a common edge of two adjacent peripheral sides of the hexagonal body associated with the first even surface and extending in accordance with a straight phantom line "S1" and a second tangential edge defined from a common edge of another two adjacent peripheral sides of the hexagonal body and extending in accordance with a straight phantom line "S2". The first and second tangential edges cooperate to define a diametrical length of the body which is the maximum. Furthermore, the first and second even surfaces are spaced at a distance smaller than a distance of a straight phantom line "O", which is equally spaced from phantom lines "S1" and "S2", with respect to either of the phantom lines "S1" and "S2". Moreover, each of the first and second even surfaces is parallel to the phantom lines "S1" and "S2", and the second even surface extends substantially on the phantom line "S2".

Preferably, the distal end 102 of the body is punched from an edge which is common to two adjacent peripheral sides.

In the tool 10, the connecting end 12 is formed such that it includes an inner side 121 defined from the first even surface and having an arcuate cross section, and an outer side 122 defined from the second even surface and having an arcuate cross section. The connecting end 12 has a center of curvature, i.e. where the cross mark is. Additionally, the connecting end 12 extends in a curved path away from the body initially and towards the body at last, and encloses a space. The center of curvature is located in the space. Furthermore, the connecting end 12 has a substantially constant thickness defining a distance between the inner side 121 and outer side 122, and which is smaller than a distance measured from a center of the body to an outer peripheral edge, which is an edge common to two adjacent peripheral sides. The connecting end 12 has a radial length which is the furthest from the center, i.e. a distance between the phantom lines "O" and either "S1" or "S2" in the embodiment, and which is smaller than a diametrical length of the body which is the minimum. The connecting end 12 also includes two opposing lateral sides 123. One lateral side 123 extends from one of two opposing edges of the inner side 121 to one of two opposing edges of the outer side 122, while the other lateral side 123 extends from the other of the two opposing edges of the inner side 121 to the other of the two opposing edges of the outer side 122. Additionally, the inner side 121, outer side 122 and two lateral sides 123 cooperate to form a shape with a cross section, i.e. being rectangular, which is different from a cross section of the body and is of a size smaller than that of the body. The connecting end 12 further includes a slopping section 124 defined from the fifth even surface so that it extends between the inner side 121 and outer peripheral edge of the body. The slopping section 124 has an arcuate cross section. The connecting end 12 further includes a tip side 125 extending between the inner side 121 and the outer side 122 as well as between the two lateral sides 123, and the connecting end 12 is terminated at the tip side 125. In the embodiment, the tip side 125 corresponds to and faces the slopping section 124.

Furthermore, the connecting end 12 has a height greater than the maximum diametrical length of the body, i.e. the distance between the phantom lines "S1" and "S2" in the embodiment. The connecting end 12 has a first point "P1" which has the lowest height not disposed outside one of the two opposing tangential edges, i.e. the phantom line "S2", and has a second point "P2" which has the highest height disposed outside the other of the two opposing tangential edges, i.e. the phantom line "S1". Moreover, the connecting end 12 gradually descends in height from the second point "P2" as it approaches its tip side 125, and the tip side 125 has a portion disposed inside the other of the two opposing tangential edges, i.e. phantom line "S1". Moreover, the connecting end 12 is formed such that the outer side 122 has a tangential line cooperating with the other of the two opposing tangential edges, i.e. phantom line "S1" to form an obtuse angle "$\alpha$".

Furthermore, the body and tip side 125 have a gap 126 spacing them marginally, as it is not necessary to bend the body to form the connecting end 12 such that the tip side 125 is in contact with the body. However, it is probable that the tip side 125 is in contact with the body.

Figure 3:
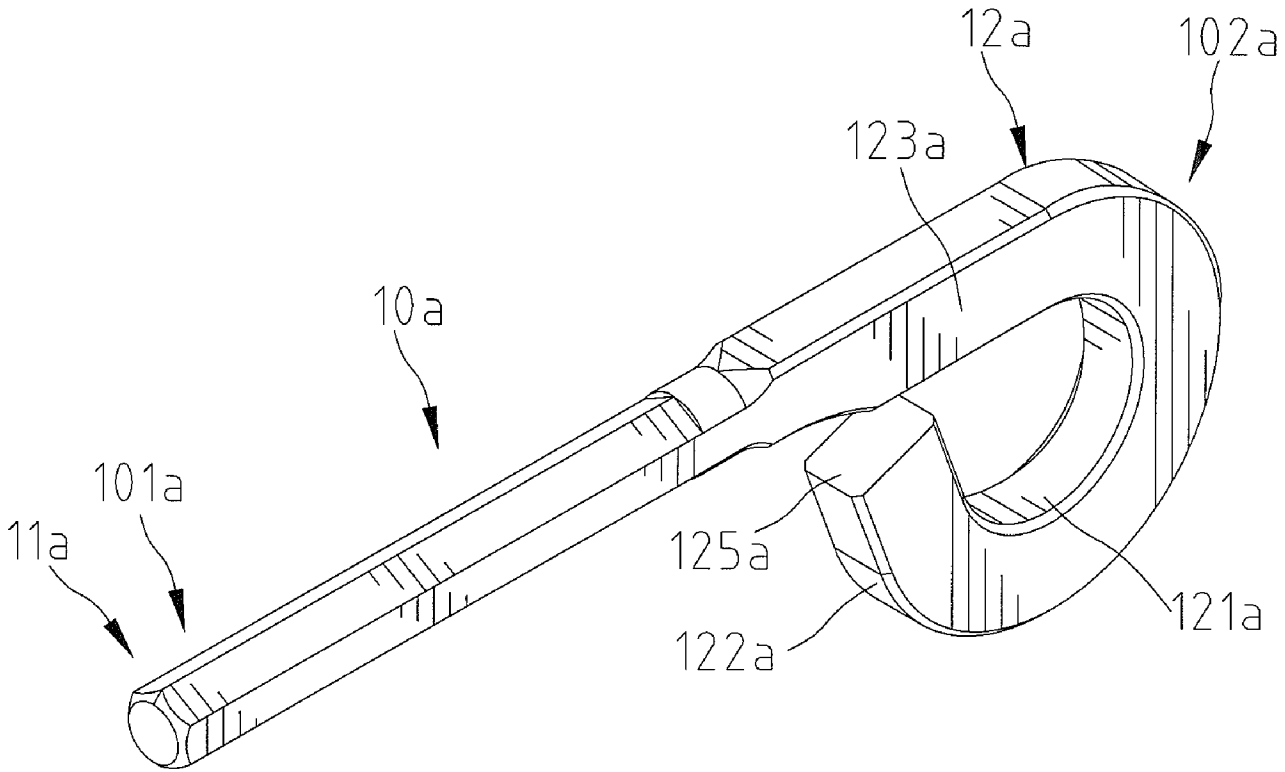
FIG. 3 is a perspective view of a tool in accordance with a second embodiment of the present invention.
Figure 4:
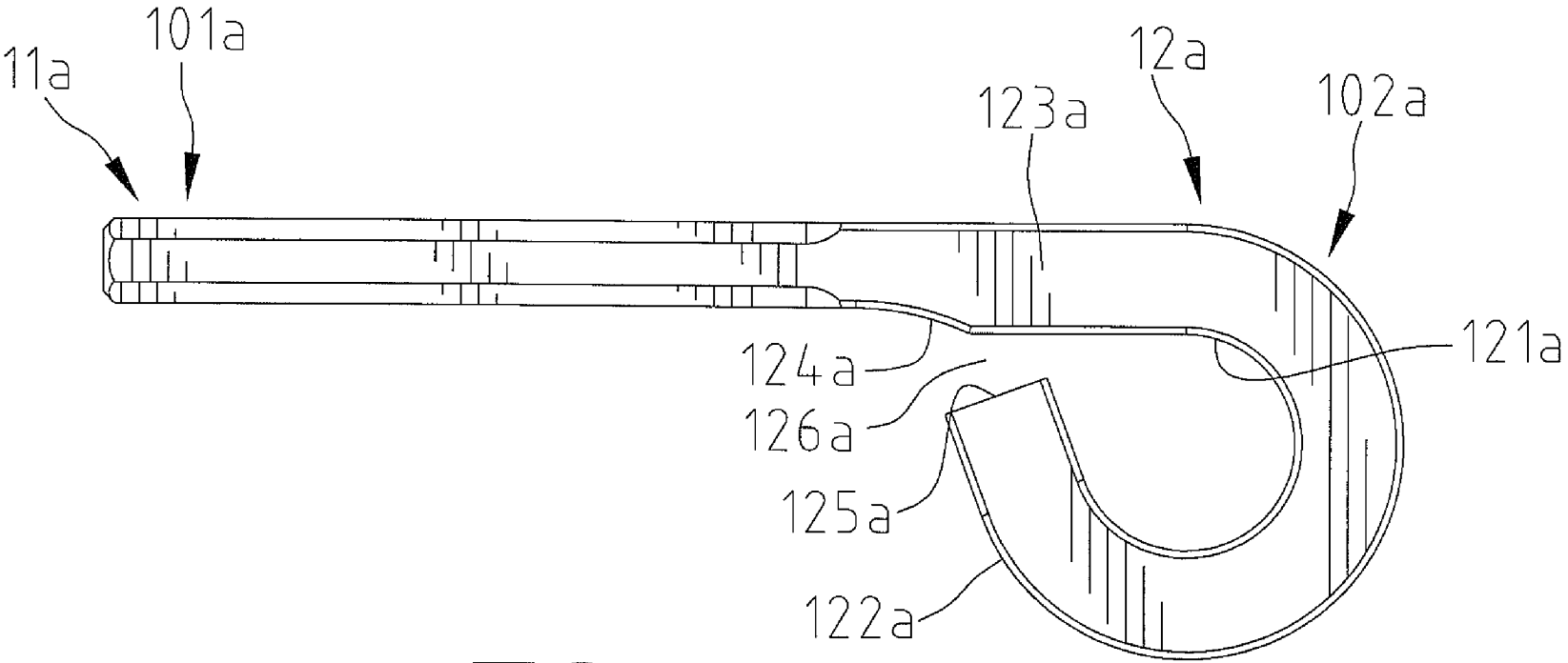
FIG. 4 is a side view of the tool of FIG. 3.

FIGS. 3 and 4 show a tool 10*a* in accordance with a second embodiment of the present invention. The tool 10*a* is made from a body including a proximal end 101*a* and a distal end 102*a* opposing each other, and the proximal end 101*a* defines a driving end 11*a* of the tool 10*a*. In addition, the tool 10*a* includes a connecting end 12*a* formed by bending the distal end 102*a* of the body. Prior to forming the connecting end 12*a*, the distal end 102*a* of the body includes a rectangular cross section including a first pair of even surfaces and a second pair of even surfaces. In the tool 10*a*, the connecting end 12*a* is formed such that it includes an inner side 121*a* defined from a first even surface of first pair even surfaces and having an arcuate cross section, and an outer side 122*a* defined from a second even surface of first pair even surfaces and having an arcuate cross section. Additionally, the connecting end 12*a* extends in a curved path away from the body initially and towards the body at last, and encloses a space. Furthermore, the connecting end 12*a* has a substantially constant thickness defining a distance between the inner side 121*a* and the outer side 122*a*.

The connecting end 12*a* also includes two opposing lateral sides 123*a* defined from the two second pair of even surfaces, respectively. The connecting end 12*a* further includes a slopping section 124*a* extending between the inner side 121*a* and the outer peripheral edge of the body. The body has a diametrical length, which is the maximum, of a size smaller than the thickness of the connecting end 12*a*. The connecting end 12*a* further includes a tip side 125*a* extending between the inner side 121*a* and the outer side 122*a* as well as between the two lateral sides 123*a*, and the connecting end 12*a* is terminated at the tip side 125*a*. Furthermore, the connecting end 12*a* is formed such that the outer side 122*a* has a tangential line cooperating with the outer peripheral edge of the body to form an obtuse angle. Moreover, the body and the tip side 125*a* have a gap 126*a* spacing them marginally, as it is not necessary to bend the body to form the connecting end 12*a* such that the tip side 125*a* is in contact with the body. However, it is probable that the tip side 125*a* is in contact with the body.

Figure 5:
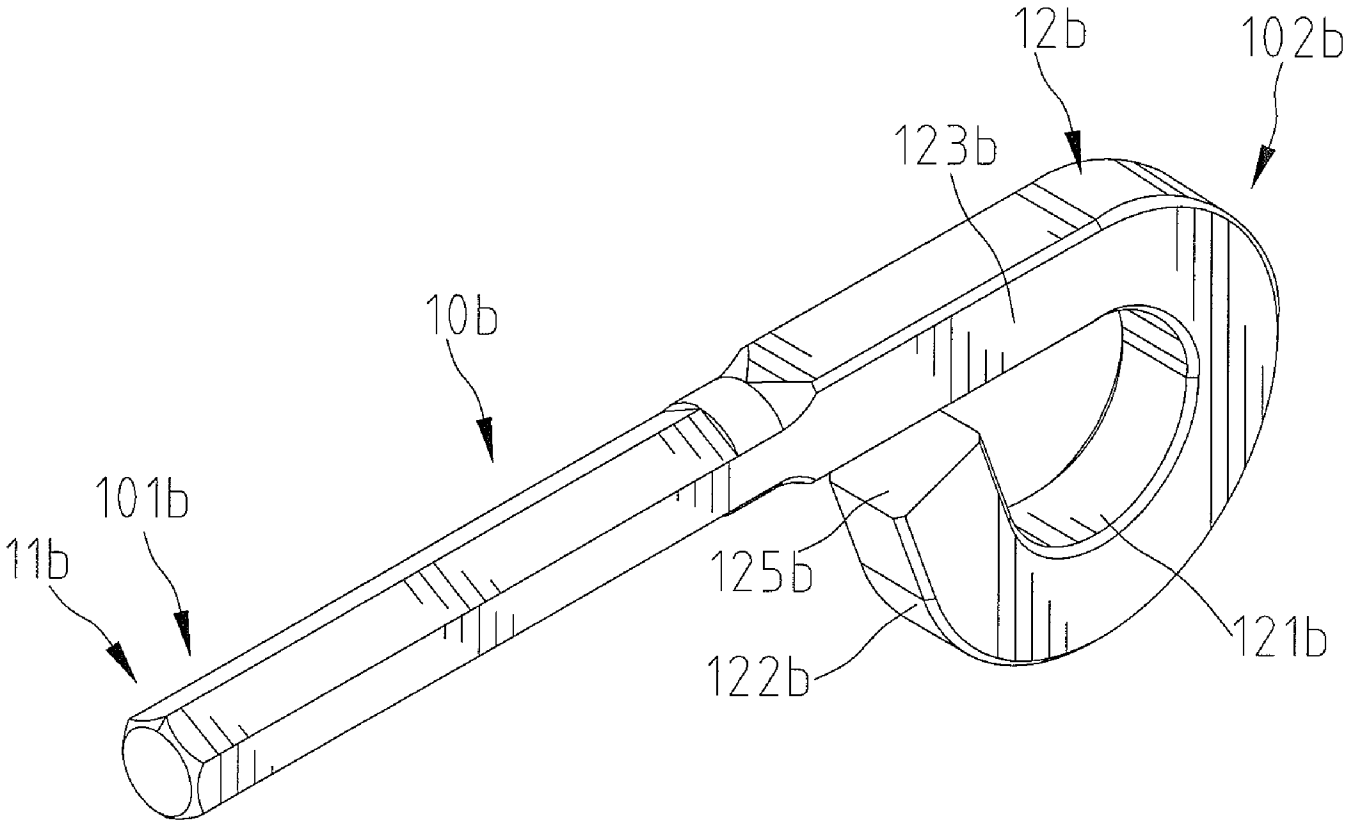
FIG. 5 is a perspective view of a tool in accordance with a third embodiment of the present invention.
Figure 6:
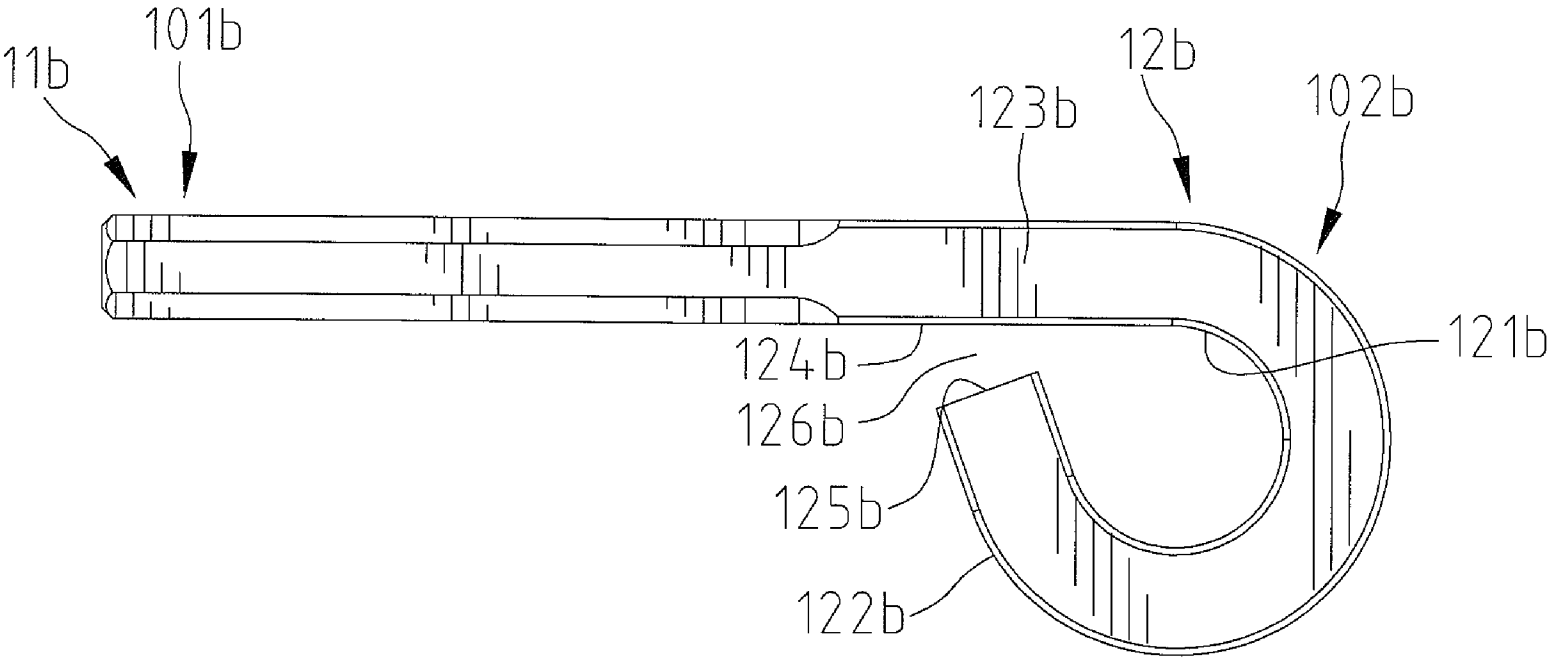
FIG. 6 is a side view of the tool of FIG. 5.

FIGS. 5 and 6 show a tool 10*b* in accordance with a third embodiment of the present invention. The tool 10*b* is made from a body including a proximal end 101*b* and a distal end 102*b* opposing each other. The proximal end 101*b* defines a driving end 11*b* of the tool 10*b*. In addition, the tool 10*b* includes a connecting end 12*b* formed by bending the distal end 102*b* of the body. Prior to forming the connecting end 12*b*, the distal end 102*b* of the body includes a rectangular cross section including a first pair of even surfaces and a second pair of even surfaces. In the tool 10*b*, the connecting end 12*b* is formed such that it includes an inner side 121*b* defined from a first even surface of the first pair of even surfaces and having an arcuate cross section, and an outer side 122*b* defined from a second even surface of the first pair of even surfaces and having an arcuate cross section. Additionally, the connecting end 12*b* extends in a curved path away from the body initially and towards the body at last, and encloses a space. Furthermore, the connecting end 12*b* has a substantially constant thickness defining a distance between the inner side 121*b* and the outer side 122*b*.

The connecting end 12*b* also includes two opposing lateral sides 123*b* defined from the two second pair of even surfaces, respectively. The connecting end 12*b* further includes a slopping section 124*b* extending between the inner side 121*b* and the outer peripheral edge of the body. The body has a diametrical length, which is the maximum, of a size equal to the thickness of the connecting end 12*b*. The connecting end 12*b* further includes a tip side 125*b* extending between the inner side 121*b* and the outer side 122*b* as well as between the two lateral sides 123*b*, and the connecting end 12*b* is terminated at the tip side 125*b*. Furthermore, the connecting end 12*b* is formed such that the outer side 122*b* has a tangential line cooperating with the outer peripheral edge of the body to form an obtuse angle. Moreover, the body and the tip side 125*b* have a gap 126*b* spacing them marginally, as it is not necessary to bend the body to form the connecting end 12*b* such that the tip side 125*b* is in contact with the body. However, it is probable that the tip side 125*b* is in contact with the body.

Figure 7:
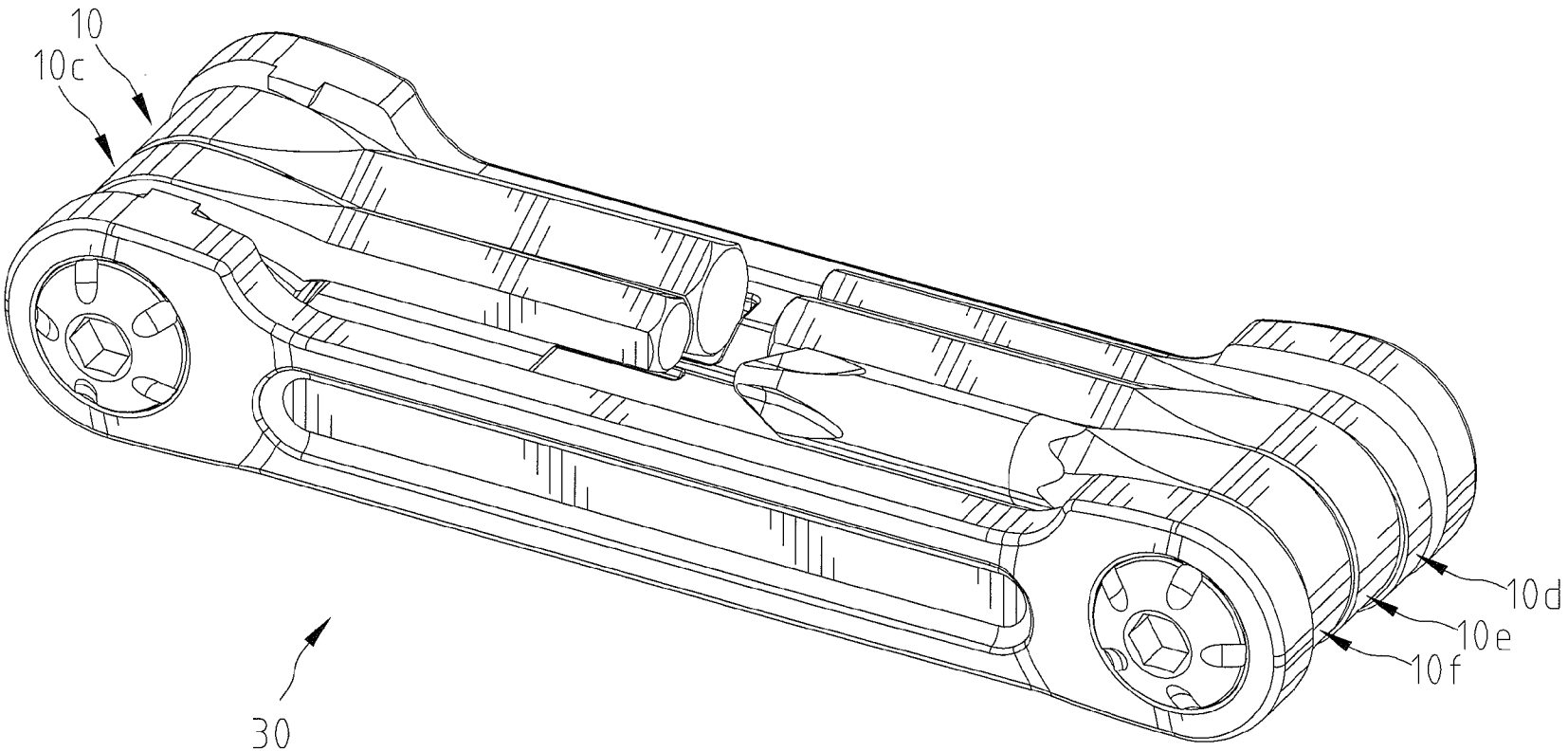
FIG. 7 is perspective view showing a plurality of tools of the present invention pivotally connected to a housing member to create a tool set.
Figure 8:
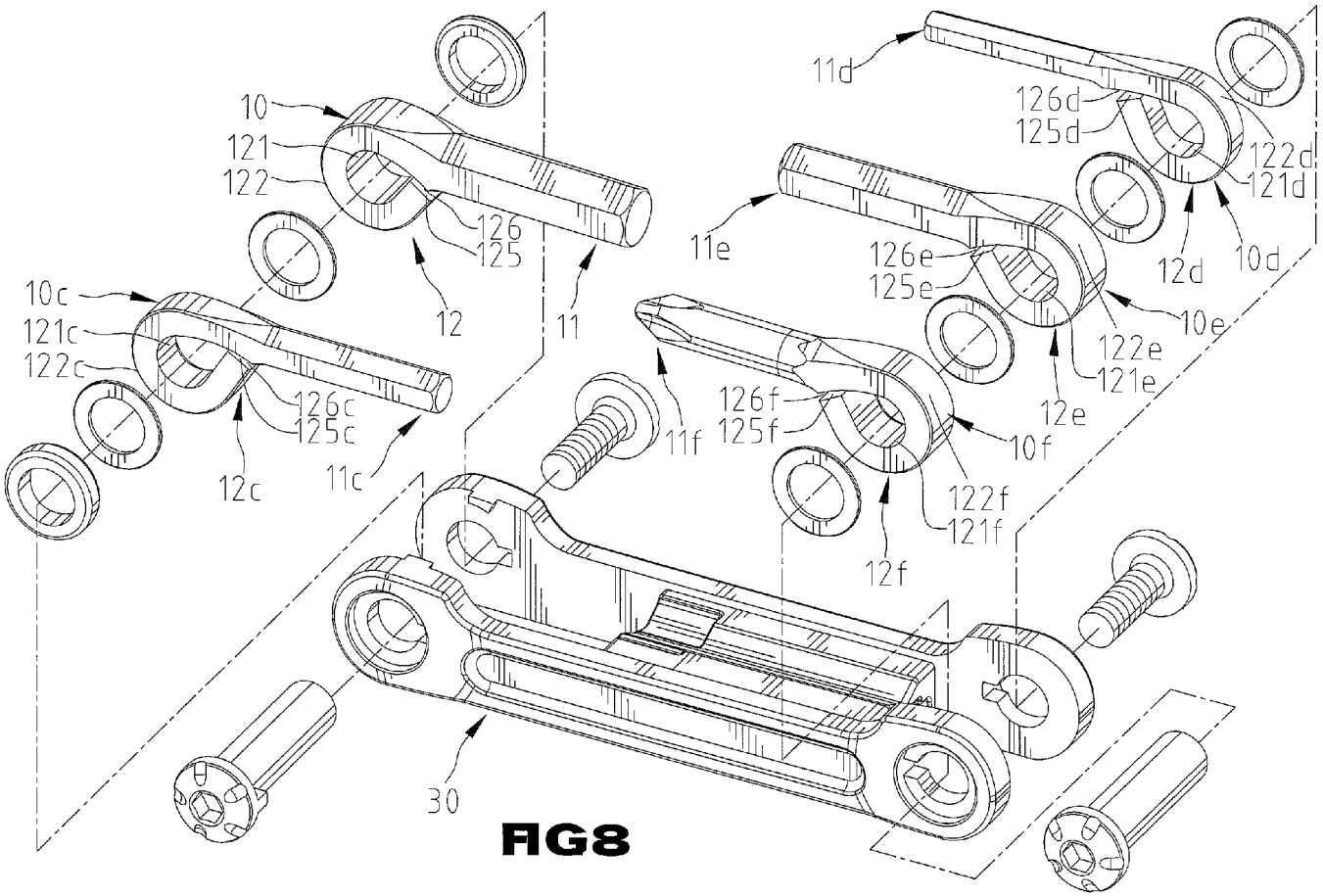
FIG. 8 is an exploded perspective view of the tool set shown in FIG. 7.
Figure 9:
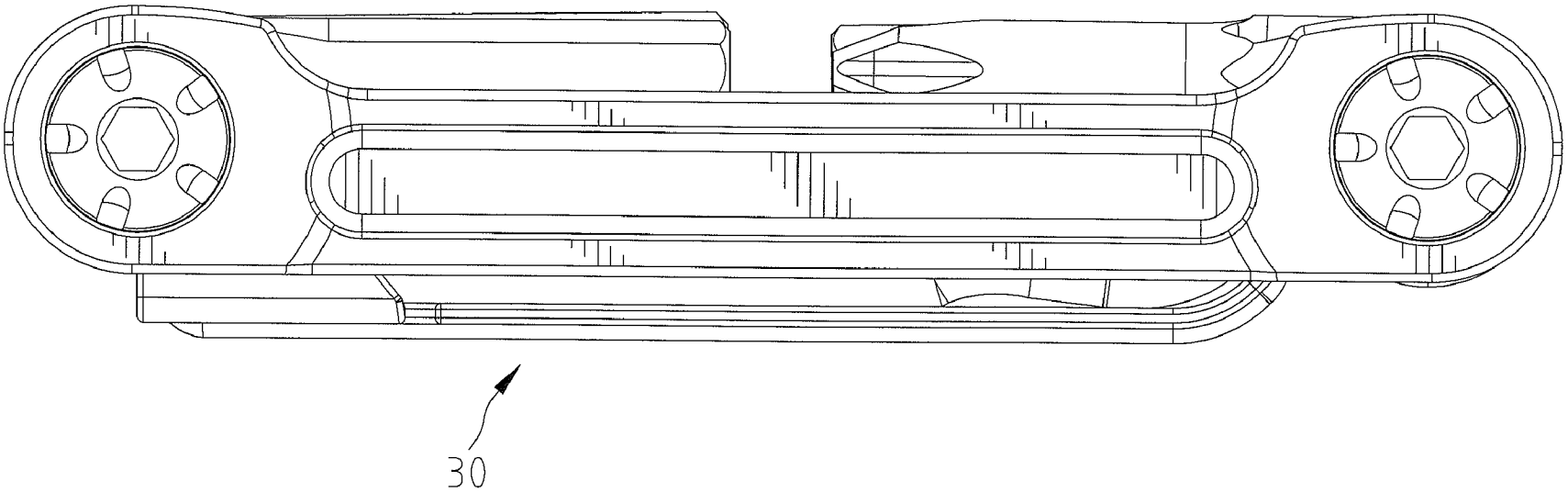
FIG. 9 is a side view of the tool set of FIG. 7.
Figure 10:
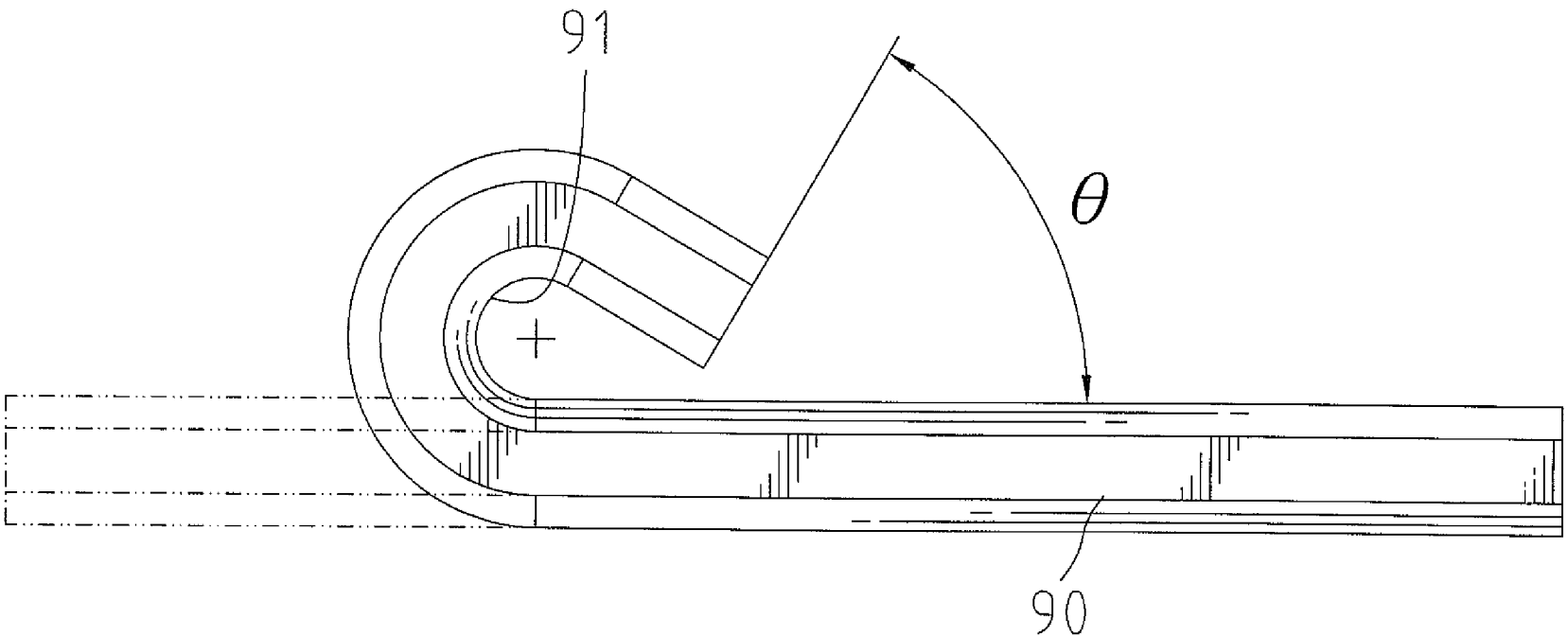
FIG 10 PRIOR ART
FIG. 10 is a side view of a conventional tool.
Figure 11:
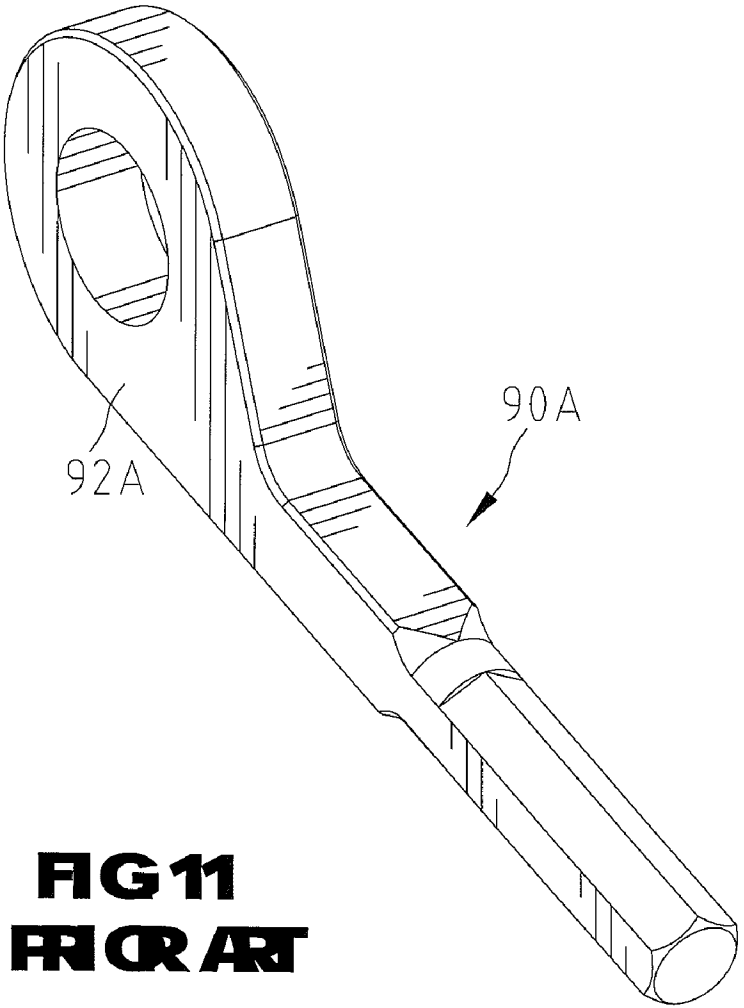
FIG 11 PRIOR ART
FIG. 11 is a perspective view of another conventional tool.

FIGS. 7 through 9 show the tool 10 and a plurality of tools embodying the present invention 10*c*, 10*d*, 10*e*, and 10*f* pivotally connected to a housing member 30 to create a tool set. Like the prior embodiments, the tools 10*c*, 10*d*, 10*e*, and 10*f* include connecting ends 12*c*, 12*d*, 12*e*, and 12*f* made from a distal end of the body, which has a rectangular cross section, respectively. The connecting ends 12*c*, 12*d*, 12*e*, and 12*f* also include even inner and outer sides 121*c*, 121*d*, 121*e*, and 121*f*; 122*c*, 122*d*, 122*e*, and 122*f*, tip sides 125*c*, 125*d*, 125*e*, and 125*f*, and gaps 126*c*, 126*d*, 126*e*, and 126*f*, respectively. Furthermore, the connecting ends 12*c*, 12*d*, 12*e*, and 12*f* are formed such that the outer side 122*c*, 122*d*, 122*e*, and 122*f* has a tangential line cooperating with the outer peripheral edge of the body to form an obtuse angle, respectively. The housing member 30 includes a recess in which the tools 10, 10*c*, 10*d*, 10*e*, and 109*f* are pivotal between a position in the recess and a position outside the recess. In the embodiment, the tools 10 and 10*c* are pivotally connected to the housing member 30 by a first pivot inserted through the housing member 30 and their connecting ends 12 and 12*c*; while the tools 10*d*, 10*e* and 10*f* are pivotally connected to the housing member 30 by a second pivot inserted through the housing member 30 and their connecting ends 12*d*, 12*e* and 12*f*. Furthermore, the tools 10, 10*c*, 10*d*, 10*e* and 10*f* include driving ends 11, 11*c*, 11*d*, 11*e* and 11*f* configured differently to perform a specific procedure.

In view of the forgoing, when connecting the tool 10 on the first pivot, the inner side 121 of the connecting end 12 would have a surface contact area on the first pivot, since the inner side 121 is an even surface rather than being formed of two peripheral sides which are angled with one another, as in the conventional tools. Likewise, it is understood that each of the tools 10*a*, 10*b*, 10*c*, 10*d*, 10*e*, and 10*f* would have a surface contact area on a respective pivot it connects. Furthermore, the tools 10, 10*a*, 10*b*, 10*c*, 10*d*, 10*e*, and 10*f* are less liable to stress concentration and to break during forming the respective connecting end 12, 12*a*, 12*b*, 12*c*, 12*d*, 12*e*, and 12*f*, since the distal end has been manufactured to include the first even surface and the second even surface. Furthermore, the connecting ends 12, 12*a*, 12*b*, 12*c*, 12*d*, 12*e* and 12*f* of the respective tools 10, 10*a*, 10*b*, 10*c*, 10*d*, 10*e* and 10*f* are allowed to have the same thickness. As a result, the tool set can have its thickness reduced by as much as 60%, and the connecting ends 12, 12*c*, 12*d*, 12*e* and 12*f* are therefore flush with one another as shown in FIG. 9.

While the specific embodiments have been illustrated and described, numerous modifications come to mind without significantly departing from the spirit of invention, and the scope of invention is only limited by the scope of the accompanying claims.

What is claimed is:

1. A tool adapted to be pivotally connected to a housing member, comprising:

a body;

a driving end formed on a proximal end of the body for performing a specific procedure; and a bent connecting end formed on a distal end of the body by bending the distal end, with the connecting end having a rectangular cross section, with the body between the connecting end and the driving end having a hexagonal cross section different than the rectangular cross section; and wherein the connecting end extends in a path away from the body initially and towards the body at last and encloses a space and includes an inner side and an outer side which are substantially even, with the inner side enabling the tool to have a surface contact area with a pivot in the housing member;

wherein the connecting end includes a tip side that defines where the connecting end terminates, with the tip side spaced from the body of toot by a gap, and wherein the connecting end extends in a curved path, with the inner side and the outer side having an arcuate cross section.

2. The tool as claimed in claim 1, wherein the connecting end has a substantially constant thickness defining a distance between the inner side and the outer side.

3. The tool as claimed in claim 1, wherein the outer side of the connecting end has a tangential line cooperating with an outer peripheral edge of the body to form an obtuse angle.

4. The tool as claimed in claim 1, wherein the housing member includes a recess defined therein, and wherein the tool is pivotal between a first position in the recess and a second position outside the recess.

* * * * *